US010799747B2

(12) United States Patent
Saffaie

(10) Patent No.: US 10,799,747 B2
(45) Date of Patent: Oct. 13, 2020

(54) PORTABLE AND FOLDABLE GLUTEUS MAXIMUS BRIDGING AND HIP THRUSTING EXERCISE APPARATUS

(71) Applicant: Mike Saffaie, Redondo Beach, CA (US)

(72) Inventor: Mike Saffaie, Redondo Beach, CA (US)

( * ) Notice: Subject to any disclaimer, the term of this patent is extended or adjusted under 35 U.S.C. 154(b) by 0 days.

(21) Appl. No.: 16/115,488

(22) Filed: Aug. 28, 2018

(65) Prior Publication Data

US 2019/0299045 A1 Oct. 3, 2019

Related U.S. Application Data

(60) Provisional application No. 62/649,538, filed on Mar. 28, 2018.

(51) Int. Cl.

*A63B 21/055* (2006.01)
*A63B 21/00* (2006.01)
*A63B 21/04* (2006.01)

(52) U.S. Cl.

CPC ..... *A63B 21/0557* (2013.01); *A63B 21/4011* (2015.10); *A63B 21/4033* (2015.10); *A63B 21/0442* (2013.01); *A63B 21/4023* (2015.10); *A63B 2208/0242* (2013.01); *A63B 2210/50* (2013.01)

(58) Field of Classification Search

CPC ..... A63B 21/0557; A63B 21/4033; A63B 2210/50; A63B 21/0442; A63B 2208/0242; A63B 21/4023; A63B 21/4011–4029

See application file for complete search history.

(56) References Cited

U.S. PATENT DOCUMENTS 2,938,572 A * 5/1960 Solloway ..... A47C 20/08 297/296
3,741,538 A * 6/1973 Lewis ..... A63B 17/00 482/120
4,253,260 A * 3/1981 Maza ..... G09F 15/0062 116/63 P
4,463,947 A * 8/1984 Kloenne ..... A61H 1/024 482/139
4,796,369 A * 1/1989 Hamann ..... G09F 15/0056 116/63 P
5,110,122 A * 5/1992 Moore ..... A63B 21/023 482/112

(Continued)

OTHER PUBLICATIONS

Home | The Booty Pro—Official Site / https://thebootypro.com.

*Primary Examiner* — Andrew S Lo
(74) *Attorney, Agent, or Firm* — The Law Office of Judd M. Patton; Judd M. Patton

(57) ABSTRACT

An apparatus that satisfies the need for a portable and foldable exercise equipment to perform glute bridge, hip thrust and other resistance band exercises without the need for additional equipment. The apparatus includes opposing panels hingedly connected, and accommodations to affix resistance bands to the panels. A cross member is preferably hingedly connected to one panel and extends through an opening and engages the other panel. A resistance band may include an adjustable belt so that a user may securely fasten himself or herself between the opposing panels and the resistance band to perform the glute bridge, hip thrust or other exercises.

15 Claims, 10 Drawing Sheets

(56) References Cited

U.S. PATENT DOCUMENTS 5,232,426 A * 8/1993 Van Straaten ..... A63B 21/154 482/123
6,042,523 A * 3/2000 Graham ..... A63B 21/0552 482/121
6,245,001 B1 * 6/2001 Siaperas ..... A63B 21/04 482/123
6,500,104 B1 * 12/2002 Rich ..... A63B 21/04 482/123
D473,272 S * 4/2003 Heins ..... D21/685
6,716,144 B1 * 4/2004 Shifferaw ..... A63B 21/023 297/161
7,013,590 B1 * 3/2006 Bell ..... G09F 15/0062 40/610
7,137,933 B2 * 11/2006 Shifferaw ..... A63B 21/023 482/121
7,410,450 B1 * 8/2008 Paulding ..... A63B 21/0552 482/120
D605,492 S * 12/2009 De Leone ..... A63B 69/0059 D8/323
8,695,141 B1 * 4/2014 Villareal ..... B65G 69/30 14/69.5
8,939,872 B2 * 1/2015 Sprague ..... A63B 21/00047 297/423.1
9,649,522 B2 * 5/2017 Wyatt ..... A63B 71/0036
9,782,622 B2 * 10/2017 Hornback ..... A63B 21/4033
2002/0166725 A1 * 11/2002 Gulledge ..... B25H 1/06 182/153
2006/0194679 A1 * 8/2006 Hatcher ..... A63B 21/04 482/123
2007/0087920 A1 * 4/2007 Dachraoui ..... A63B 21/0552 482/123
2011/0319232 A1 * 12/2011 Thorpe ..... A63B 21/4035 482/91
2012/0329619 A1 * 12/2012 Goldberg ..... A63B 21/04 482/129
2013/0090216 A1 * 4/2013 Jackson ..... A63B 21/018 482/52
2013/0197403 A1 * 8/2013 Sevy ..... A63B 21/0442 601/5
2014/0113780 A1 * 4/2014 Emmert ..... A63B 23/02 482/123
2016/0140886 A1 * 5/2016 Green, Jr. ..... G08B 5/38 40/581
2017/0056708 A1 * 3/2017 Kelly ..... A63B 21/4029
2018/0008857 A1 * 1/2018 Barber ..... A63B 69/0059
2018/0068536 A1 * 3/2018 Green, Jr. ..... H04N 7/188
2018/0178058 A1 * 6/2018 Fano ..... A63B 21/4037
2018/0326258 A1 * 11/2018 Kordecki ..... A63B 23/0482
2019/0022459 A1 * 1/2019 Hoeven ..... A63B 21/4033
2019/0111302 A1 * 4/2019 Ballestero ..... A63B 21/0414
2019/0126122 A1 * 5/2019 Vester ..... A63B 71/0036
2019/0160322 A1 * 5/2019 McCarthy ..... A63B 21/00069

* cited by examiner

CALIFORNIA STATE UNIVERSITY, FULLERTON

Pablo B. Costa
*Department of Kinesiology*
800 N. State College Blvd., KHS 254, Fullerton, CA 92831 / Office: (657) 278-4232 / Email: pcosta@fullerton.edu

| Feet Supported | | | Feet Elevated | | | Feet Elevated Abducted | | | Single Leg Foot Elevated | | | Single Leg Foot Supported | | |
|---|---|---|---|---|---|---|---|---|---|---|---|---|---|---|
| Vastus Lateralis | Hamstrings | Gluteus Maximus | Vastus Lateralis | Hamstrings | Gluteus Maximus | Vastus Lateralis | Hamstrings | Gluteus Maximus | Vastus Lateralis | Hamstrings | Gluteus Maximus | Vastus Lateralis | Hamstrings | Gluteus Maximus |
| 22.0% | 18.2% | 31.8% | 39.9% | 74.2% | 60.6% | 41.6% | 98.7% | 69.1% | 59.9% | 100.0% | 100.0% | 100.0% | 70.3% | 85.8% |

| Feet Elevated Blue Resistance | | | Feet Elevated Abducted Blue Resistance | | | Feet Elevated Black Resistance | | | P2 Feet Elevated Black Resistance | | | P2 Feet Supported Black Resistance | | |
|---|---|---|---|---|---|---|---|---|---|---|---|---|---|---|
| Vastus Lateralis | Hamstrings | Gluteus Maximus | Vastus Lateralis | Hamstrings | Gluteus Maximus | Vastus Lateralis | Hamstrings | Gluteus Maximus | Vastus Lateralis | Hamstrings | Gluteus Maximus | Vastus Lateralis | Hamstrings | Gluteus Maximus |
| 42.4% | 92.2% | 72.2% | 29.5% | 72.1% | 63.8% | 83.6% | 57.7% | 61.0% | 36.8% | 85.5% | 60.3% | 81.7% | 65.7% | 59.1% |

FIG. 13

CALIFORNIA STATE UNIVERSITY, FULLERTON
Pablo B. Costa
*Department of Kinesiology*
800 N. State College Blvd., KHS 254, Fullerton, CA 92831 / Office: (657) 278-4232 / Email: pcosta@fullerton.edu
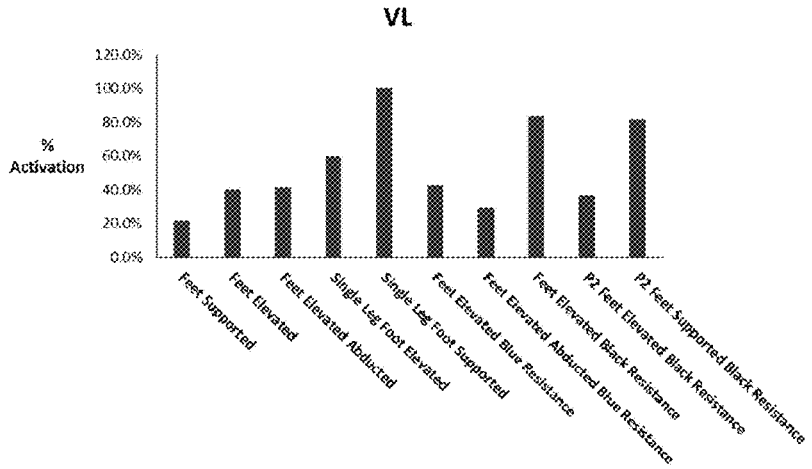
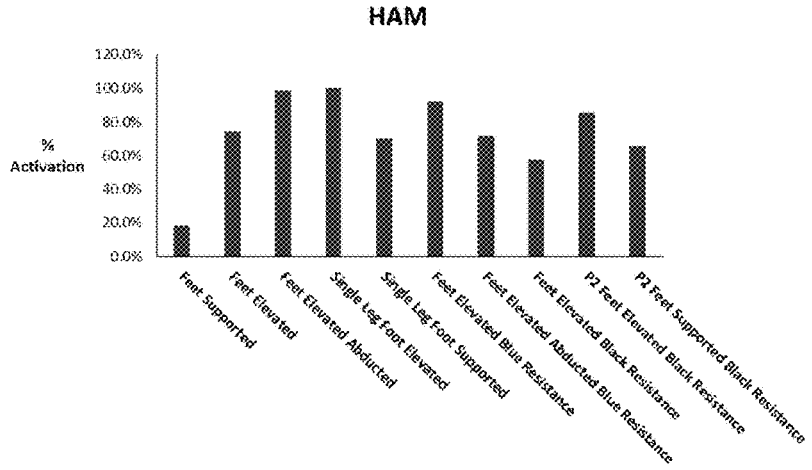
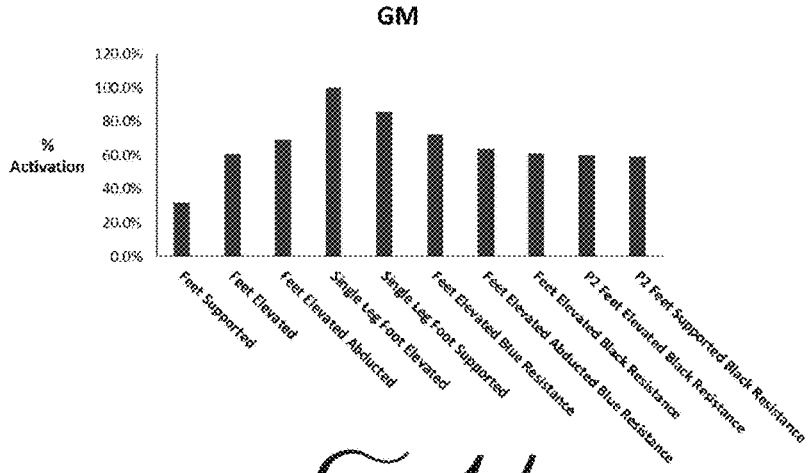
FIG. 14

PORTABLE AND FOLDABLE GLUTEUS MAXIMUS BRIDGING AND HIP THRUSTING EXERCISE APPARATUS

RELATED APPLICATIONS

This application claims priority to provisional application No. 62/649,538 filed Mar. 28, 2018 entitled "Portable and Foldable Gluteus Maximus Bridging and Hip Thrusting Exercise Apparatus."

BACKGROUND

The Gluteus Maximus (glutes) and surrounding muscles (e.g. hamstring, vastus lateralis, etc.) are very popular muscle groups from aesthetic and sports performance perspectives. The glute muscles are commonly worked out using the glute bridge exercise performed when lying in a supine position with feet planted on the floor with the knees bent, and thrusting the hips into the air while engaging the buttocks muscles. The exercise may also be performed at a greater intensity by planting the feet on an elevated surface. Another method is the hip thrust performed while lying in a supine position with shoulders on an elevated surface higher than the planted feet, and thrusting the hips into the air using the hip muscles. These methods of exercise, at various intensity levels, are generally performed using large or heavy pieces of equipment at gyms or health clubs.

Few portable pieces of equipment designed for the glute bridge and hip thrust exercises exist, leaving individuals to use leg extension machines, barbells and other exercise equipment, which makes performing the exercises uncomfortable, a hassle or unsafe. Individuals may also perform the glute bridge on a flat surface using a resistance band by holding the band onto the floor while performing the glute bridge. This method of exercise can result in injury, however, if the user does not hold the resistance bands tight enough, and can be problematic for individuals with carpal tunnel syndrome, arthritis or other ailments and injuries.

Even portable equipment used to perform glute bridges and hip thrusts can be bulky and difficult to store and transport. Portable equipment also does not enable a user to perform these exercises with feet elevated above the surface without requiring the use of additional equipment such as an exercise block.

For the foregoing reasons, what is needed is an apparatus to safely perform glute bridge and hip thrust exercises at high intensity using resistance bands, that can be folded for optimal storage and transportation ease. Thus, there is a need for a light weight, compact and foldable exercise apparatus that is specifically designed for both the glute bridge and hip thrust exercises, on a flat or elevated surface without the need for additional pieces of equipment, for frequent and convenient use at home or wherever the user may be.

SUMMARY

An apparatus that satisfies the need for a portable and foldable exercise equipment to safely perform gluteus maximus and hip thrust exercises. The apparatus includes a front panel and opposing rear panel hingedly connected at the top. The panels include a top edge and a bottom edge, an inner side and an outer side, and oppose one another such that the inner side of the panels face each other. A cross bar spans between the bottom sides of the panels and adjusts the angle of separation between the panels. One end of the cross bar includes slotted grooves to selectively engage one of the panels, and includes a handle. The other end of the cross bar is hingedly or otherwise connected to the other panel.

A resistance band spans across the outer side of the bottom edge of the front panel or opposing rear panel, and may include an adjustable belt. The front panel and/or opposing rear panel may include multiple attachment points for varying the location of the resistance band across the opposing panels. Alternatively, the opposing panels may include a plurality of openings for coupling the resistance band to the opposing panels.

These and other features, aspects, and advantages of the present invention will become better understood with reference to the following description and appended claims.

BRIEF DESCRIPTION OF THE DRAWINGS

FIG. 13 is numerical data of muscle activation readings of the vastus lateralis, hamstring and gluteus maximus muscles while performing the glute bridge exercise in different bodily configurations.

FIG. 14 is a bar graph representation of the numerical data of muscle activation readings of the vastus lateralis, hamstring and gluteus maximus muscles while performing the glute bridge exercise in different bodily configurations.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1:
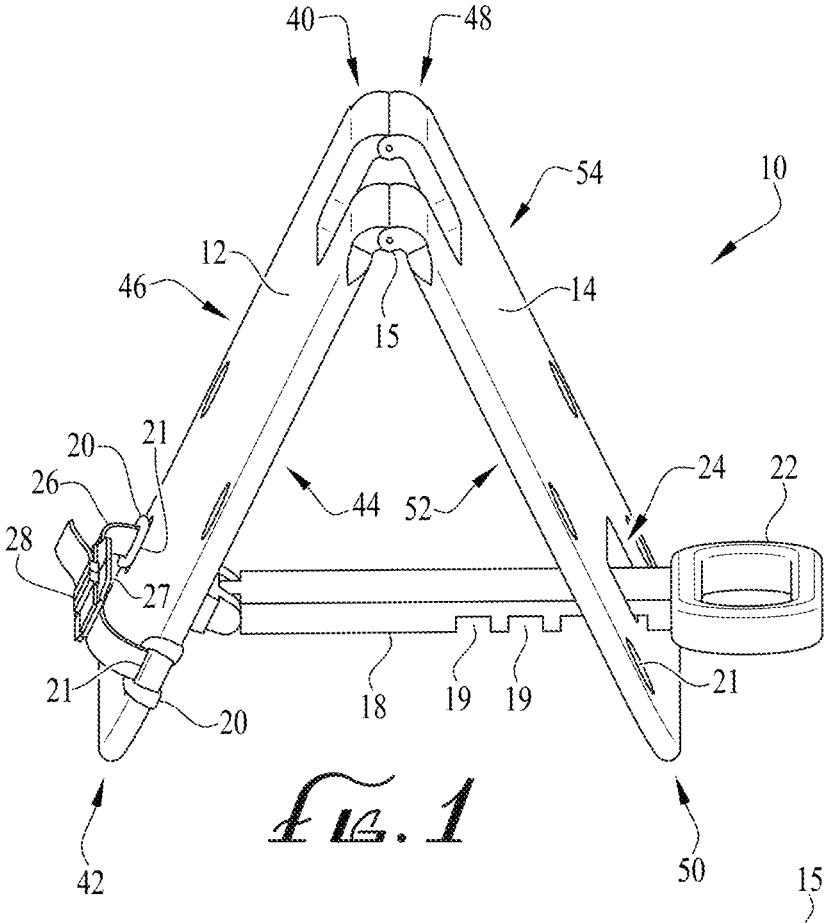
FIG. 1 illustrates a perspective view of a preferred embodiment of the exercise apparatus.
Figure 2:
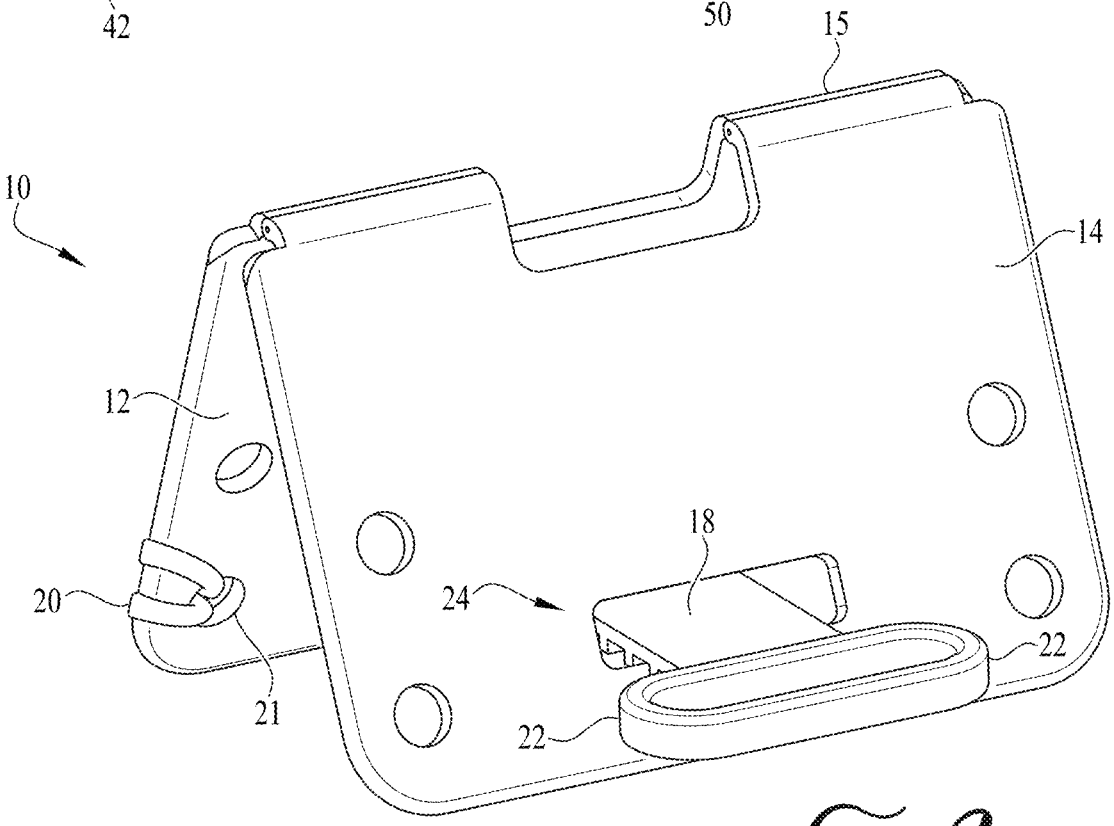
FIG. 2 illustrates a perspective rear view of the preferred embodiment of the exercise apparatus.

Referring to FIGS. 1-2, a foldable and portable exercise apparatus 10 for preferably performing glute bridge and hip thrust exercises is shown in an open configuration. The apparatus is generally comprised of a front panel 12, an opposing rear panel 14, a cross member 18 and a handle 22. The front panel 12 includes a front panel top edge 40, front panel bottom edge 42, front panel inner side 44 and front panel outer side 46. The opposing rear panel 14 includes an opposing rear panel top edge 48, an opposing rear panel bottom edge 50, an opposing rear panel inner side 52 and an opposing rear panel outer side 54. The front panel 12 and opposing rear panel 14 are preferably about 15 inches in height (between the top and bottom edges), 20 inches in width, 1 inch in thickness, and have rounded, non-sharp edges to prevent injury to the user or damage to the surface onto which the apparatus 10 is placed during use. In the preferred embodiment, the front panel 12 and opposing rear panel 14 are hingedly connected by a panel hinge 15 along the front panel top edge 40 and opposing rear panel top edge 48. In another embodiment, the front panel 12 and opposing rear panel 14 may be foldably connected or otherwise connected such that the front panel 12 and opposing rear panel 14 pivot in relation to one another. The front panel 12 and opposing rear panel 14 are preferably made of a rigid plastic material although the material may be wood or an otherwise rigid material to prevent excessive bending. The surface is preferably somewhat rough to prevent excessive slipping or sliding of the feet during the glute bridge exercise, or the upper back during the hip thrust exercise.

Still referring to FIGS. 1-2, the cross member 18, preferably a cross bar, is coupled to the front panel inner side 44 of the front panel 12 by a cross member hinge 17. The cross member 18 extends through an opposing rear panel opening 24 of the opposing rear panel 14, adjacent the front panel bottom edge 42 and opposing rear panel bottom edge 50. The handle 22 is located on the cross member 18 opposite the cross member hinge 17, and adjacent the opposing rear panel outer side 54 of the opposing rear panel 14. As shown, the handle 22 is sized such that the width of the handle 22 is larger than the opposing rear panel opening 24, preventing the handle 22 from passing through the rear panel opening 24. The cross member 18 includes grooves 19 sized to receive a width of the opposing rear panel 14 such that the angle formed between the front panel 12 and opposing rear panel 14 may be adjusted and locked into place. The preferred angle between the front panel 12 and opposing rear panel 14 during use of the apparatus 10 is preferably between 45 and 60 degrees, although the angle may be adjusted to a lesser angel to perform a higher intensity workout, or a greater angle to perform a lower intensity workout.

Still referring to FIGS. 1-2, the front panel 12 and opposing rear panel 14 include one or more resistance band openings 21 sized to receive a resistance bands strap 20 coupled to a resistance band 26. The resistance band openings 21 are preferably in pairs along the same horizontal plane and adjacent the vertical edge of the front panel 12 and opposing rear panel 14, and are about 1 inch in diameter. The front panel 12 and opposing rear panel 14 preferably include more than one pair of resistance band openings 21 such that a resistance band 26 may be placed at different heights respective to the surface to which the apparatus 10 is placed. In another embodiment (not shown), a plurality of fasteners (not shown) are present on the front panel 12 along the front panel outer side 46, and the opposing rear panel 14 along the opposing rear panel outer side 54 such that a resistance band 26 may be placed at different heights. In the preferred embodiment, the resistance band 26 extends laterally across the front panel 12 and/or opposing rear panel 14 and includes an adjustable belt 27 and a buckle 28.

Figure 3:
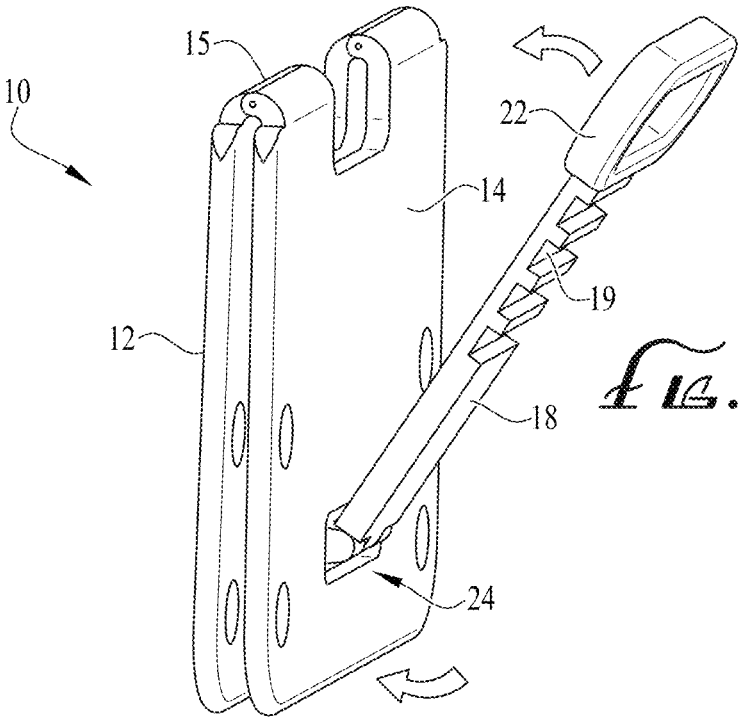
FIG. 3 illustrates a step of folding the preferred embodiment of the exercise apparatus for purposes of storage and transport.
Figure 4:
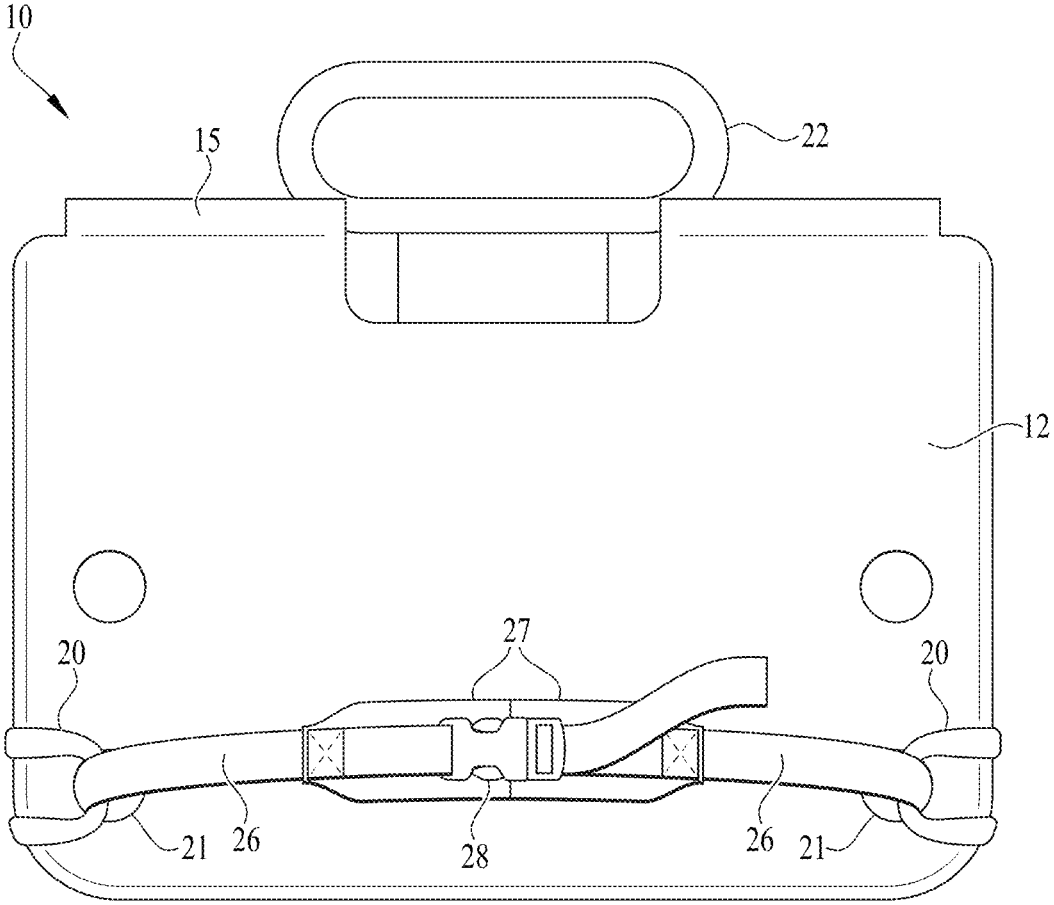
FIG. 4 illustrates a perspective view of the front of the preferred embodiment of the exercise apparatus in a closed configuration.

FIG. 3 illustrates a preferred step of closing the apparatus 10 by lifting the handle 22 upward, effectively disengaging the grooves 19 of the cross member 18 with the opposing rear panel 14 and causing the front panel 12 and opposing rear panel 14 to move substantially together, placing the apparatus 10 in a closed configuration (FIG. 4).

FIG. 4 illustrates the apparatus 10 in a closed configuration. As shown, the resistance band 26 includes a buckle 28 and a resistance band strap 20. The buckle 28 is preferably made of plastic but may also be made from metal or other durable material. In a preferred embodiment, the buckle 28 is a clip buckle. Alternatively, the buckle 28 may be a flip closure, utility, clip latch or other means to secure the resistance band 26 over a user's body during use (FIGS. 5-8). The resistance band strap 20 allows a user to secure the resistance band 26 to the desired resistance band opening 21. While in a closed configuration, a user may place the apparatus 10 on a substantially flat surface and secure a resistance band strap 20 into a resistance band opening 21 to perform a bicep curl exercise. Also while in a closed configuration, a user may insert a resistance band strap 20 of another resistance band 26 into a resistance band opening 21 to perform bilateral bicep curls, tricep extension, shoulder press, front squats, bent-over row, pushups or other exercises that may be performed using a resistance band 26 anchored to a surface.

Figure 5:
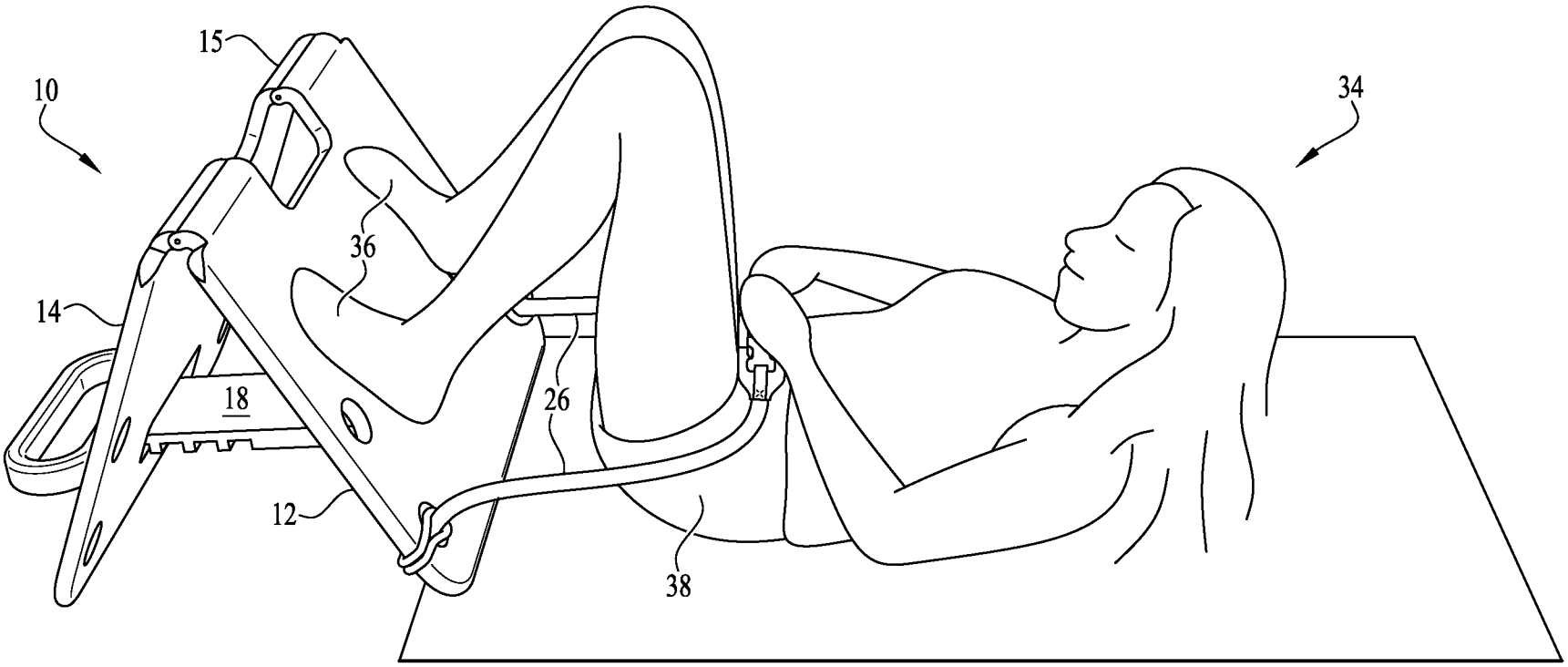
FIG. 5 illustrates a perspective view of a user securing the preferred embodiment of the exercise apparatus in preparation of performing the glute bridge exercise.
Figure 6:
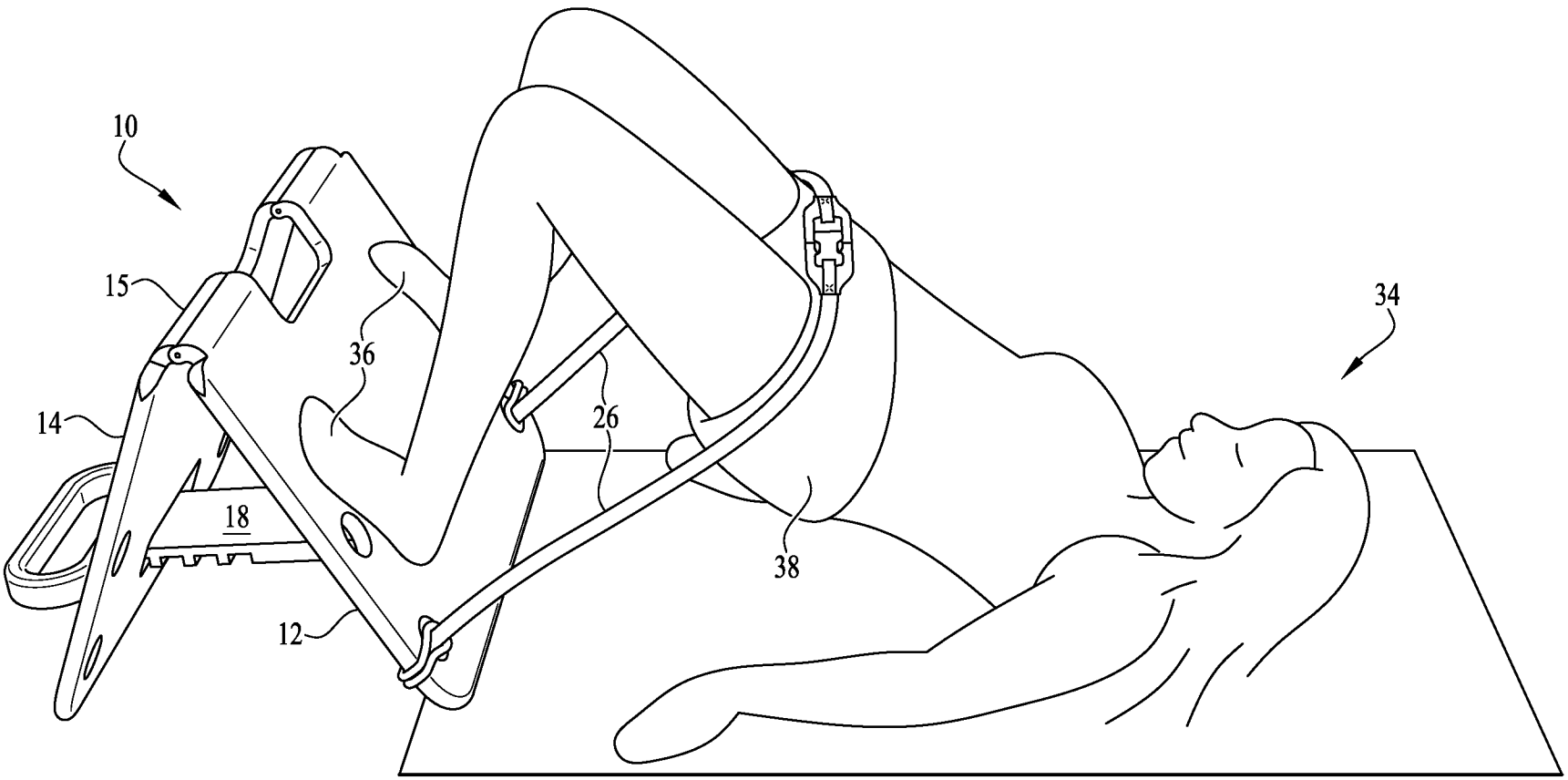
FIG. 6 illustrates a perspective view of a user performing the glute bridge exercise on the preferred embodiment of the exercise apparatus.

Referring now to FIG. 5, a user 34 may use the apparatus 10 to perform the glute bridge exercise by fastening the resistance band 26 over the user's hips 38 and placing the user's feet 36 on the front panel 12. The user 34 may adjust the adjustable belt 27 to accommodate different body shapes and sizes. Referring to FIG. 6, the user 34 may perform the glute bridge exercise by lifting the hips 38 in an upward position. The user 34 may also perform the glute bridge exercise using the opposing rear panel 14 of the apparatus 10. While FIGS. 5-6 show one user 34 using the apparatus 10 to perform the glute bridge exercise, an additional user (not shown) may simultaneously perform the exercise using a resistance band 26 secured to the opposing rear panel 14.

Figure 7:
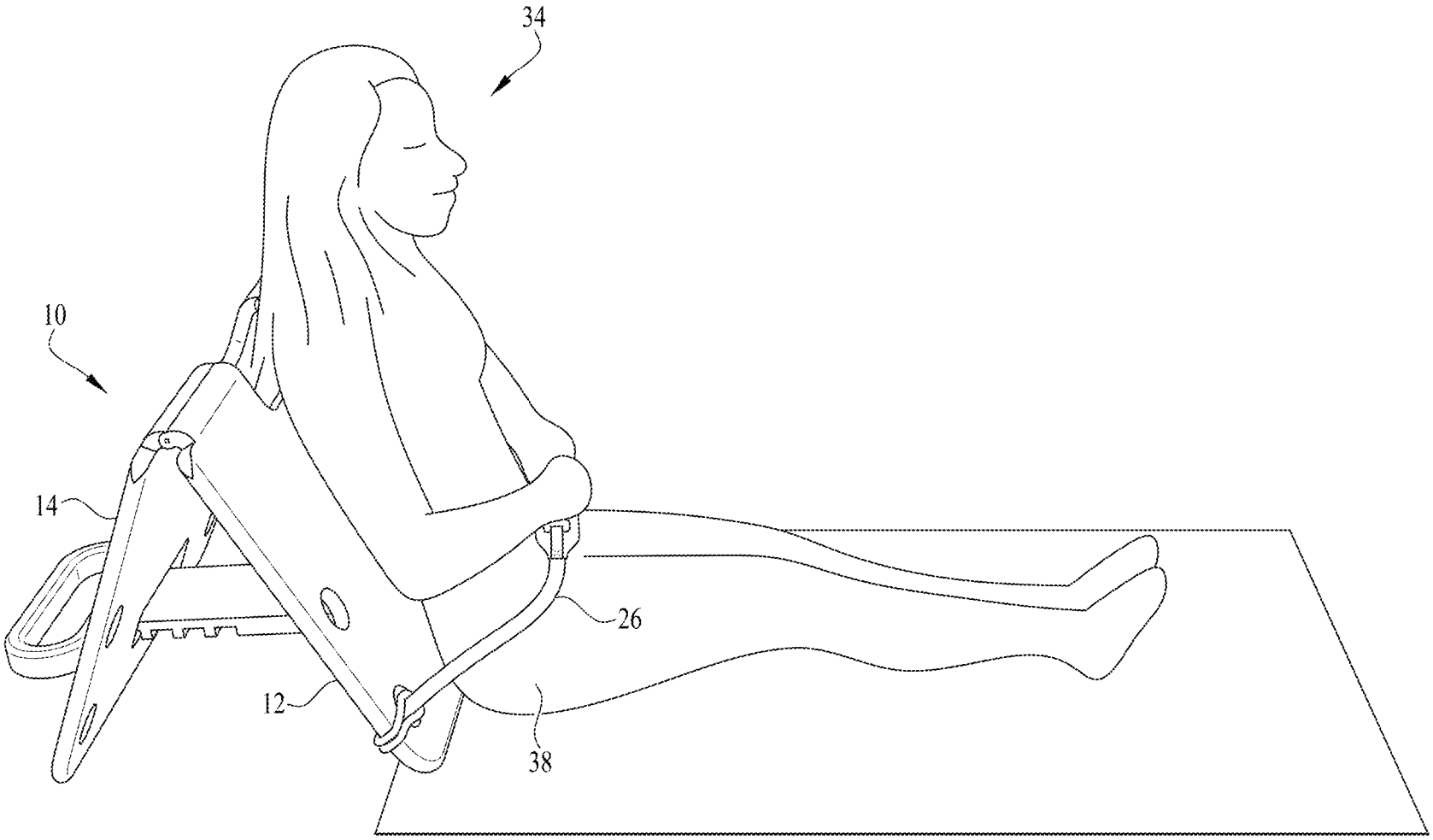
FIG. 7 illustrates a perspective view of a user securing the preferred embodiment of the exercise apparatus in preparation of performing the hip thrust exercise.
Figure 8:
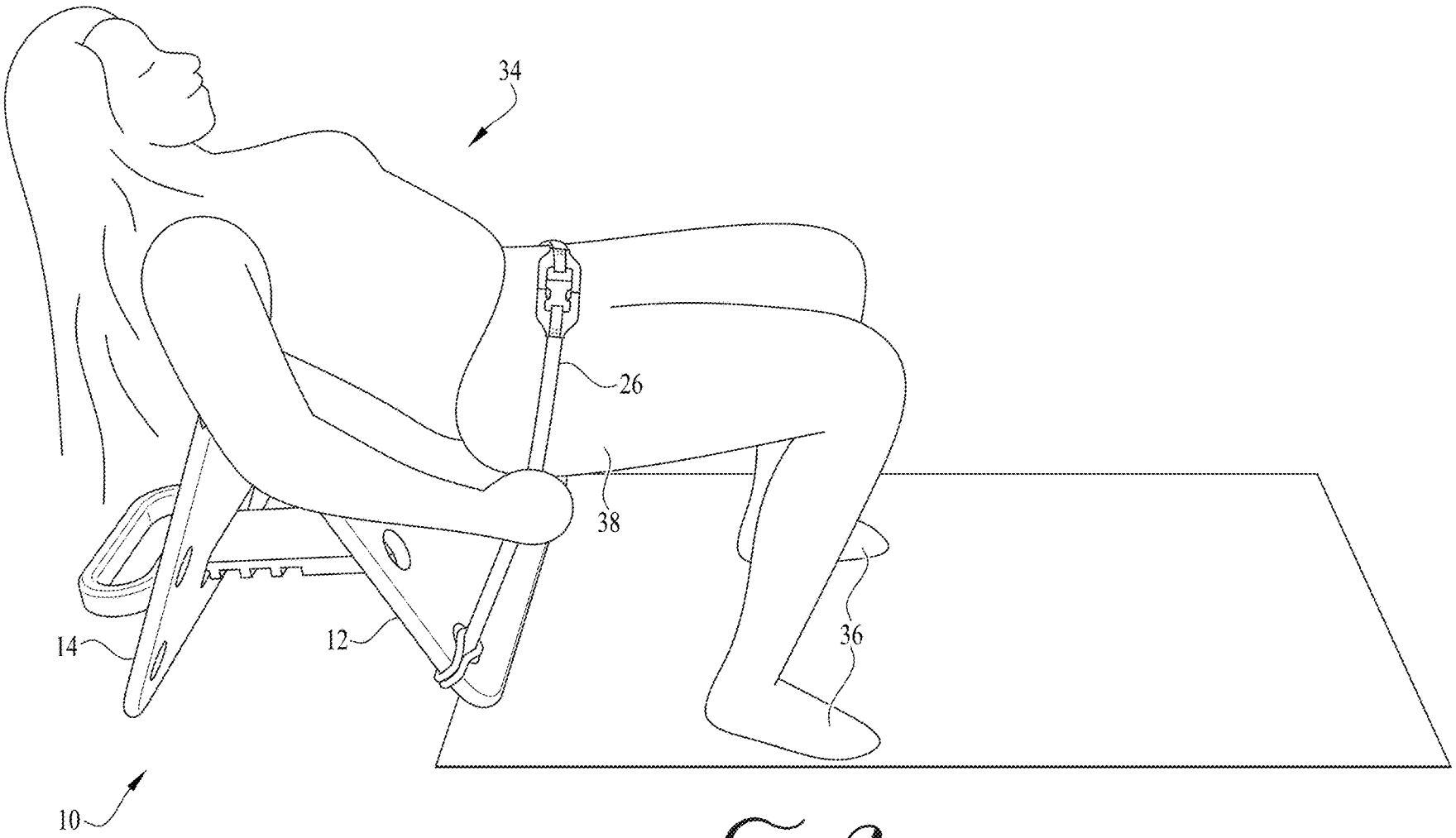
FIG. 8 illustrates a perspective view of a user performing the hip thrust exercise on the preferred embodiment of the exercise apparatus.

Referring to FIG. 7, the user 34 may use the apparatus 10 to perform the hip thrust exercise by sitting against the front panel 12 such that the user's 34 back and buttocks are substantially adjacent the front panel 12. Prior to performing the exercise, the user may place the resistance band 26 over the user's hips 38 and adjust the adjustable belt 27 as desired. As shown in FIG. 8, the user 34 may perform the hip thrust exercise by planting the user's feet 36 on the floor and thrusting the hips 38 upward. During the exercise, the user's upper back rests against the top of the front panel 12.

Figure 9:
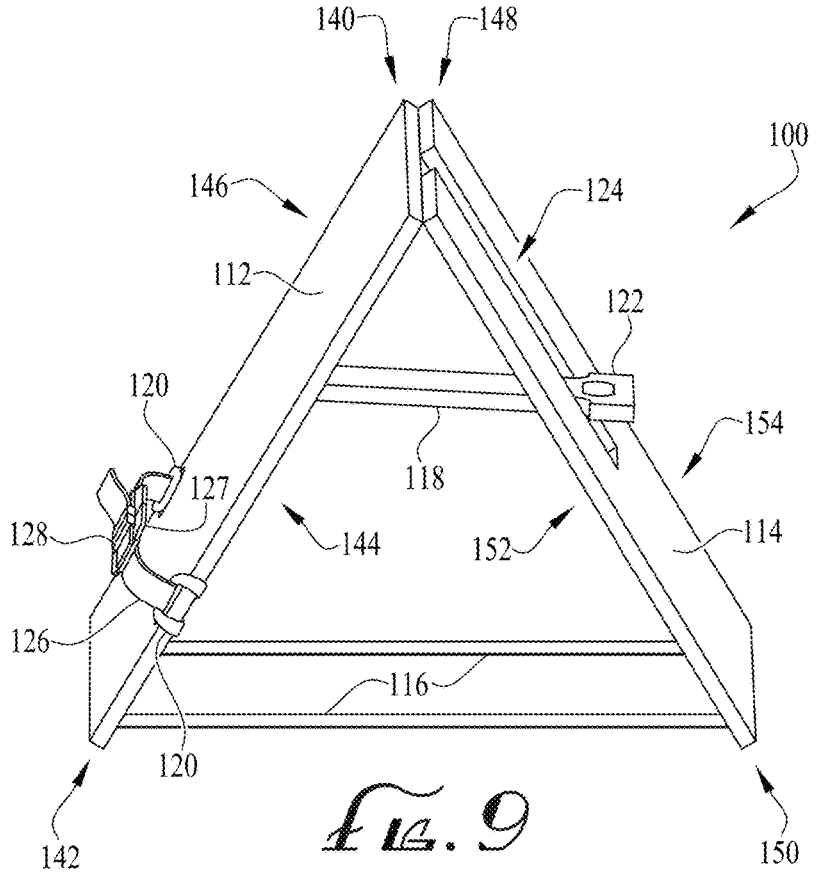
FIG. 9 illustrates a perspective view of a second embodiment of the exercise apparatus.
Figure 10:
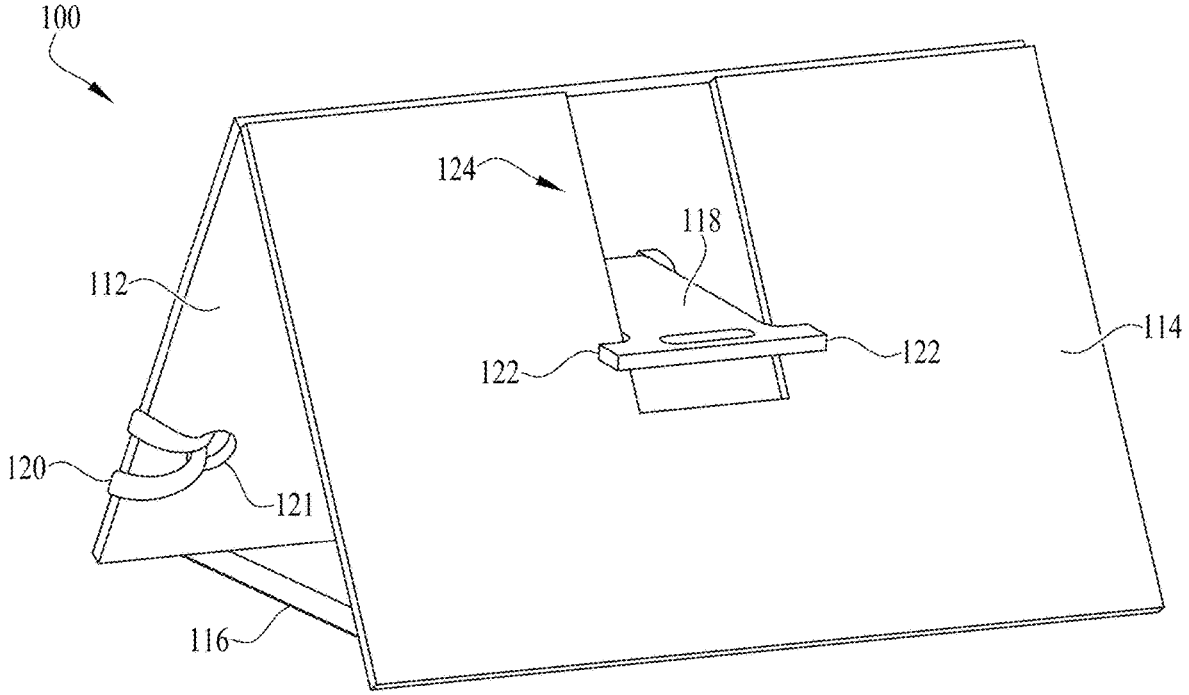
FIG. 10 illustrates a perspective rear view of the second embodiment of the exercise apparatus.

FIGS. 9-10 illustrate the second embodiment of the apparatus 100. The apparatus 100 is generally comprised of a front panel 112, opposing rear panel 114, cross member 118 and handle 122. Similar to the preferred embodiment, the front panel 112 includes a front panel top edge 140, a front panel bottom edge 142, a front panel inner side 144, and a front panel outer side 146, and the opposing rear panel 114 includes an opposing rear panel top edge 148, an opposing rear panel bottom edge 150, an opposing rear panel inner side 152 and an opposing rear panel outer side 154. The front panel 112 and opposing rear panel 114 are preferably about 15 inches in height, 20 inches in width, 2 inches deep, and have rounded corners. In one embodiment, the front panel 112 and opposing rear panel 114 are foldably connected along the front panel top edge 140 and opposing rear panel top edge 148. In another embodiment, the front panel 112 and opposing rear panel 114 are hingedly connected by way of a panel hinge (not shown) or may otherwise be connected along the front panel top edge 140 and opposing rear panel top edge 148 to oppose one another at varying degrees. The front panel 112 and opposing rear panel 114 are preferably made of a rigid plastic material although the material may be wood or an otherwise rigid material to prevent excessive bending. The surface is preferably somewhat rough to prevent excessive slipping or sliding of the feet during the glute bridge exercise, or the upper back during the hip thrust exercise.

Still referring to FIGS. 9-10, the front panel 112 includes a cross member 118 hingedly coupled to the front panel inner side 144 of the front panel 112 by a cross member hinge (not shown), although the cross member 118 may be foldably connected to the front panel 112 or otherwise connected to allow the cross member 118 to move respective to the front panel 112. At least one panel connecting strap 116 preferably extends from the front panel bottom edge 142 of the front panel 112 to the opposing rear panel bottom edge 150 of the opposing rear panel 114 to prevent the front panel 112 and opposing rear panel 114 from moving during use of the apparatus 100. The angle is preferably 60 degrees, although the apparatus 100 may be manufactured such that the angle is between about 45 and 60 degrees. The panel connecting strap 116 is preferably made from a flexible material such as a rope, but may also be made from other flexible materials such as plastic.

Still referring to FIGS. 9-10, the handle 122 is located on the cross member 118 opposite the front panel 112 and adjacent the opposing rear panel outer side 154 of the opposing rear panel 114. The opposing rear panel 114 includes an opposing rear panel opening 124 sized to receive the cross member 118, and the handle 122 is sized preferably such that the width of the handle 122 is larger than the width of the opposing rear panel opening 124 whereby the handle 122 may not pass though the opposing rear panel opening 124, also keeping the position of the front panel 112 and opposing rear panel 114 in place during use. The opposing rear panel opening 124 is preferably rectangular-shaped and extends from the top of the opposing rear panel 114 to preferably the middle of the opposing rear panel 114.

Still referring to FIGS. 9-10, the front panel 112 and opposing rear panel 114 includes one or more resistance band openings 121, preferably sized 2 inches in diameter, to receive the resistance band strap 120 of a resistance band 126. The resistance band openings 121 are preferably on the same horizontal plane and adjacent the vertical edges of the front panel 112 and opposing rear panel 114. The front panel 112 and opposing rear panel 114 preferably include more than one set of resistance band openings 121 such that a resistance band 126 may be placed at different heights respective to the surface to which the apparatus 100 is placed. Alternatively, the front panel 112 and opposing rear panel 114 may include fasteners (not shown) along the front panel outer side 146 and opposing rear panel outer side 154. In the preferred embodiment, the resistance band 126 extends laterally across the front panel outer side 146 of the front panel 112 and includes an adjustable belt 127 and a buckle 128. The resistance band 126 may also extend laterally across the opposing rear panel outer side 154 of the opposing rear panel 114.

Figure 11:
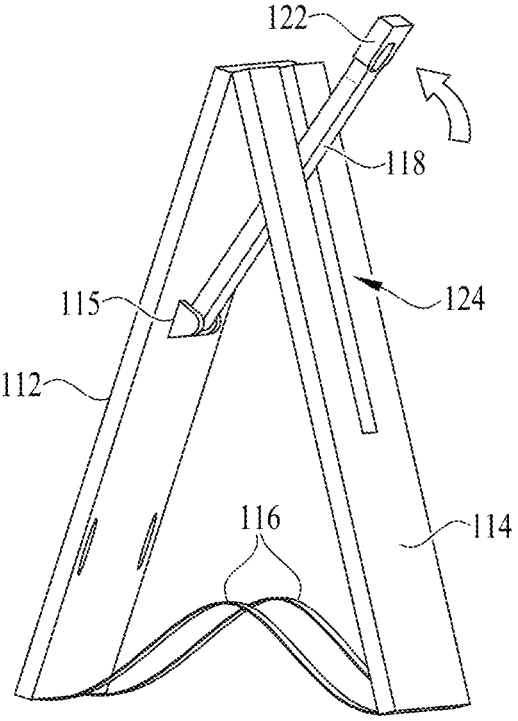
FIG. 11 illustrates a step of folding the second embodiment of the exercise apparatus for purposes of storage and transport.
Figure 12:
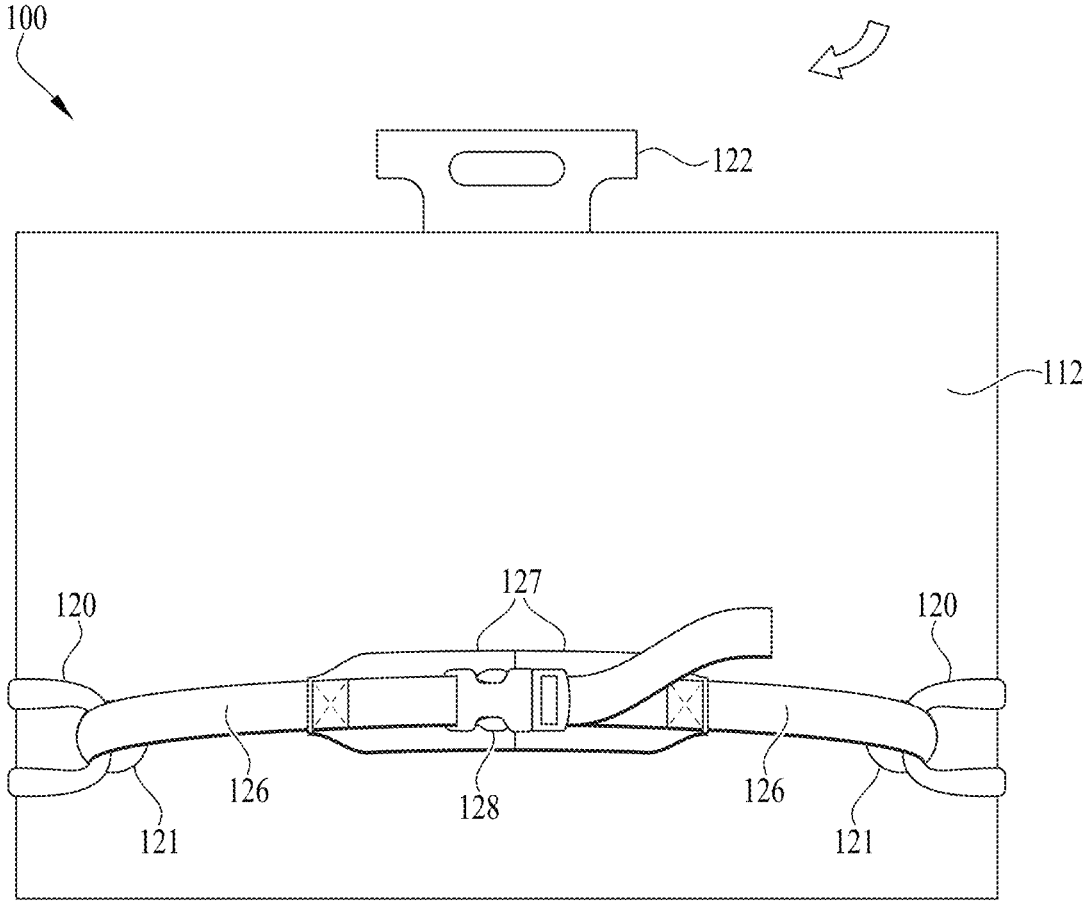
FIG. 12 illustrates a perspective view of the front of the second embodiment of the exercise apparatus in a closed configuration.

Referring now to FIG. 11, a preferred step of closing the apparatus 100 is shown as lifting the handle 122 upward, causing the front panel 112 and opposing rear panel 114 to move substantially together such that the apparatus 100 is in a closed configuration (FIG. 12). Pin hinge 115, being connected to front panel 112, may form a pivot point to facilitate such preferred step of closing apparatus 100. FIG. 12 shows the apparatus 100 in a closed configuration. As shown, the adjustable belt 127 includes a buckle 128. The buckle 128 is preferably made of a plastic material but may also be made from metal or other durable material. In a preferred embodiment, the buckle 128 is a clip buckle. Alternatively, the buckle 128 may be a flip closure, utility, clip latch, or other buckle to secure the resistance band 126 over a user's body during use (FIGS. 5-8).

FIGS. 13-14 illustrate numerical data and corresponding bar graphs of electromyography (EMG) test results conducted by the California State University, Fullerton Department of Kinesiology. The test was performed by placing sensors on selected muscles to measure electrical activity and performing the glute bridge exercise over multiple repetitions. When using the apparatus, muscle activation was generally higher when compared to performing the same exercise on a flat surface. The following description of the results presents muscle activation readings of the vastus lateralis, hamstring and gluteus maximus muscles, respectively, performing the exercise in different bodily configurations. When the exercise was performed with one or both feet planted on the apparatus, the apparatus was opened at a 45 degree angle.

The first bar graph column ("Feet Supported") shows muscle activation with both feet planted on the ground, measuring muscles activity at 22.0, 18.2 and 31.8%. The second column ("Feet Elevated") shows muscle activation with both feet planted on the apparatus, measuring at 39.9, 74.2 and 60.6%. The third column ("Feet Elevated Abducted") shows activation of the muscles with the exercise performed using the apparatus with both feet in an abducted (pointed outward) position and planted on the apparatus, measuring at 41.6, 98.7 and 69.1%.

The fourth column ("Single Leg Foot Elevated") shows muscle activation with one foot placed on the apparatus and the other foot elevated in the air by extending the leg substantially into a straight position. Muscle activation was measured at 59.9, 100.0 and 100.0%. The fifth column ("Single Leg Foot Supported") shows muscle activation when the exercise was performed with one foot planted on the ground and the other foot in an elevated position by substantially straightening the respective leg, measuring the muscles at 100.0, 70.3 and 85.8%. The sixth column ("Feet Elevated Blue Resistance") shows muscle activation measuring at 42.4, 92.2 and 72.2% with both feet planted on the apparatus and using a resistance band. The seventh column ("Feet Elevated Abducted Blue Resistance") shows muscle activation measuring at 29.5, 72.1 and 63.8% with both feet in an abducted position and planted on the apparatus using the same resistance band. The eighth column ("Feet Elevated Black Resistance") shows muscle activation measuring 83.6, 57.7 and 61.0% with both feet planted on the apparatus using a resistance band of a higher resistance than what was used during muscle activation readings reflected in columns six and seven. The ninth and tenth columns show muscle activation using an unclaimed prototype of the apparatus.

While particular forms of the invention have been illustrated and described, it will also be apparent to those skilled in the art that various modifications can be made without departing from the spirit and scope of the invention. Accordingly, it is not intended that the invention be limited except by the appended claims.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A portable exercise apparatus for working out gluteus and surrounding muscles comprising:

a front panel having a top edge and a bottom edge and an inner side and an outer side, and an opposing panel having a top edge and a bottom edge and an inner side and an outer side, the top edges hingedly connected so the inner sides of the front panel and the opposing panel face each other;

means for maintaining a selected separation between the bottom edges depending on how the exercise apparatus is in use or in storage; and, a plurality of openings in the front panel and the opposing panel for coupling a resistance band, the resistance band spanning across the outer side of the bottom edge of the front panel or the opposing panel.

2. The portable exercise apparatus of claim 1, wherein the means for maintaining a selected separation between the bottom edges comprises a cross member extending between the front panel and the opposing panel.

3. The portable exercise apparatus of claim 1, wherein the selected separation between the front panel and the opposing panels is between about 45 and 60 degrees.

4. The portable exercise apparatus of claim 1, wherein the height of the front panel and the opposing panel is about 15 inches.

5. The portable exercise apparatus of claim 1, wherein the front panel and the opposing panel are made from a rigid plastic material.

6. The portable exercise apparatus of claim 2, wherein one end of the cross member comprises one or more slotted teeth sized to selectively engage one of the panels.

7. The portable exercise apparatus of claim 6, wherein an opposing second end of the cross member is hingedly connected to the opposing panel.

8. The portable exercise apparatus of claim 1, wherein the resistance band comprises an adjustable belt.

9. The portable exercise apparatus of claim 2, wherein the one end of the cross member further comprises a handle for carrying the apparatus.

10. The portable exercise apparatus of claim 1, further comprising multiple attachment points in the opposing panels for varying location of the resistance band.

11. A portable exercise apparatus for performing resistance band exercises comprising:

a front panel having a top edge and a bottom edge and an inner side and an outer side, and an opposing panel having a top edge and a bottom edge and an inner side and an outer side, the top edges hingedly connected so the inner sides of the front panel and the opposing panel face each other;

a cross member extending between the front panel and the opposing panel for adjustably maintaining a selected separation between the bottom edges depending on how the exercise apparatus is in use or in storage; and the cross member having a first end which protrudes beyond the outer side of the opposing panel, the first end having a handle;

wherein an upward lift of the handle causes the inner side of the front panel and the inner side of the opposing panel to move adjacent with respect to each other for said storage; and a plurality of openings in the front panel and the opposing panel for coupling a resistance band.

12. The portable exercise apparatus of claim 11, wherein one end of the cross member comprises one or more slotted teeth sized to selectively engage one of the panels.

13. The portable exercise apparatus of claim 11, wherein an opposing second end of the cross member is hingedly connected to the opposing panel.

14. The portable exercise apparatus of claim 11, wherein the resistance band includes a latching buckle located about midway along the resistance band.

15. The portable exercise apparatus of claim 11, wherein the one end of the cross member further comprises a handle for carrying the apparatus.

* * * * *